US007695294B2

(12) United States Patent
Lu

(10) Patent No.: US 7,695,294 B2
(45) Date of Patent: Apr. 13, 2010

(54) ADJUSTABLE PLUG

(75) Inventor: Yu-Lun Lu, Tu-Cheng (TW)

(73) Assignee: Chi Mei Communication Systems, Inc., Tu-Cheng, Taipei (TW)

( * ) Notice: Subject to any disclaimer, the term of this patent is extended or adjusted under 35 U.S.C. 154(b) by 0 days.

(21) Appl. No.: 12/344,662

(22) Filed: Dec. 29, 2008

(65) Prior Publication Data

US 2010/0015840 A1 Jan. 21, 2010

(30) Foreign Application Priority Data

Jul. 18, 2008 (CN) ..... 2008 1 0302795

(51) Int. Cl.
*H01R 13/44* (2006.01)

(52) U.S. Cl. ..... 439/141; 439/136

(58) Field of Classification Search ..... 439/141, 439/140, 149, 135, 136, 373
See application file for complete search history.

(56) References Cited

U.S. PATENT DOCUMENTS 3,651,444 A * 3/1972 Desso et al. ..... 439/141
4,582,376 A * 4/1986 Olsson ..... 439/514
5,030,119 A * 7/1991 Lowe ..... 439/141
5,252,082 A * 10/1993 Hsieh et al. ..... 439/141
5,370,543 A * 12/1994 Hamada et al. ..... 439/188
5,412,550 A * 5/1995 Hsieh et al. ..... 362/641
5,466,164 A * 11/1995 Miyazaki et al. ..... 439/140
5,920,459 A * 7/1999 Weber et al. ..... 361/752
6,033,247 A * 3/2000 Gregory, II ..... 439/248
6,062,881 A * 5/2000 Ellison ..... 439/141
6,231,358 B1 * 5/2001 Kerr et al. ..... 439/140
6,241,542 B1 * 6/2001 Nishide et al. ..... 439/188
6,456,500 B1 * 9/2002 Chen ..... 361/752
6,551,146 B2 * 4/2003 Nakamura ..... 439/752
6,602,086 B2 * 8/2003 Tsuji et al. ..... 439/352
6,612,853 B2 * 9/2003 Wu ..... 439/136
6,786,747 B1 * 9/2004 Kamath ..... 439/188
7,086,880 B2 * 8/2006 Uchida ..... 439/141
7,104,814 B1 * 9/2006 She et al. ..... 439/131
7,121,850 B2 * 10/2006 Yeh ..... 439/131
7,125,265 B2 * 10/2006 Weng ..... 439/131
7,144,263 B2 * 12/2006 Kamath ..... 439/188
7,153,148 B2 * 12/2006 Chen et al. ..... 439/141
7,241,153 B2 * 7/2007 He et al. ..... 439/148
7,301,596 B1 * 11/2007 Morganstern et al. ..... 349/131
7,361,032 B2 * 4/2008 Loftus ..... 439/131
7,482,680 B2 * 1/2009 Brewer et al. ..... 257/678
2001/0034147 A1 * 10/2001 Kerr et al. ..... 439/141
2002/0025703 A1 * 2/2002 Chen ..... 439/141
2006/0258196 A1 * 11/2006 Chen et al. ..... 439/141

* cited by examiner

*Primary Examiner*—T C Patel
*Assistant Examiner*—Vladimir Imas
(74) *Attorney, Agent, or Firm*—Clifford O. Chi

(57) ABSTRACT

An adjustable plug includes a main body, a connecting end, and an adjustable end sleeve. The adjustable end sleeve is slidably positioned on the main body. The connecting end protrudes from the main body. The connecting end extends through the adjustable end sleeve, and protrudes out of the adjustable end sleeve.

17 Claims, 4 Drawing Sheets

ADJUSTABLE PLUG

BACKGROUND

1. Field of the Invention

The present disclosure generally relates to plugs and, particularly, to a length adjustable plug for engaging with different sockets.

2. Description of the Related Art

Connectors having a plug and a socket coupled to the plug are often used to connect two or more electronic devices, such as mobile phones, notebook computers, and personal digital assistants, together to charge the electronic devices or transmit data between electronic devices. If the plug is long, a part of the metallic portion of the plug would be exposed when the plug engages with a socket. Thus, users may get an electric shock from the exposed metallic portion of the plug. However, if the plug is not long enough, an electric contact between the plug and a corresponding socket may be insufficient. Therefore, plugs and sockets must be made with a standardized size, such as length and cross-section.

However, a plug and a corresponding type socket may not be engaged sufficiently with each other. For example, if a socket is positioned in a corner of a device, a corresponding plug may can not engage sufficiently with the socket if a main body of the plug is too large.

Therefore, a new plug is desired to overcome the above-described shortcomings.

BRIEF DESCRIPTION OF THE DRAWINGS

The components in the drawings are not necessarily drawn to scale, the emphasis instead being placed upon clearly illustrating the principles of the present adjustable plug. Moreover, in the drawings, like reference numerals designate corresponding parts throughout several views, and all the views are schematic.

DETAILED DESCRIPTION OF THE EMBODIMENTS

Figure 1:
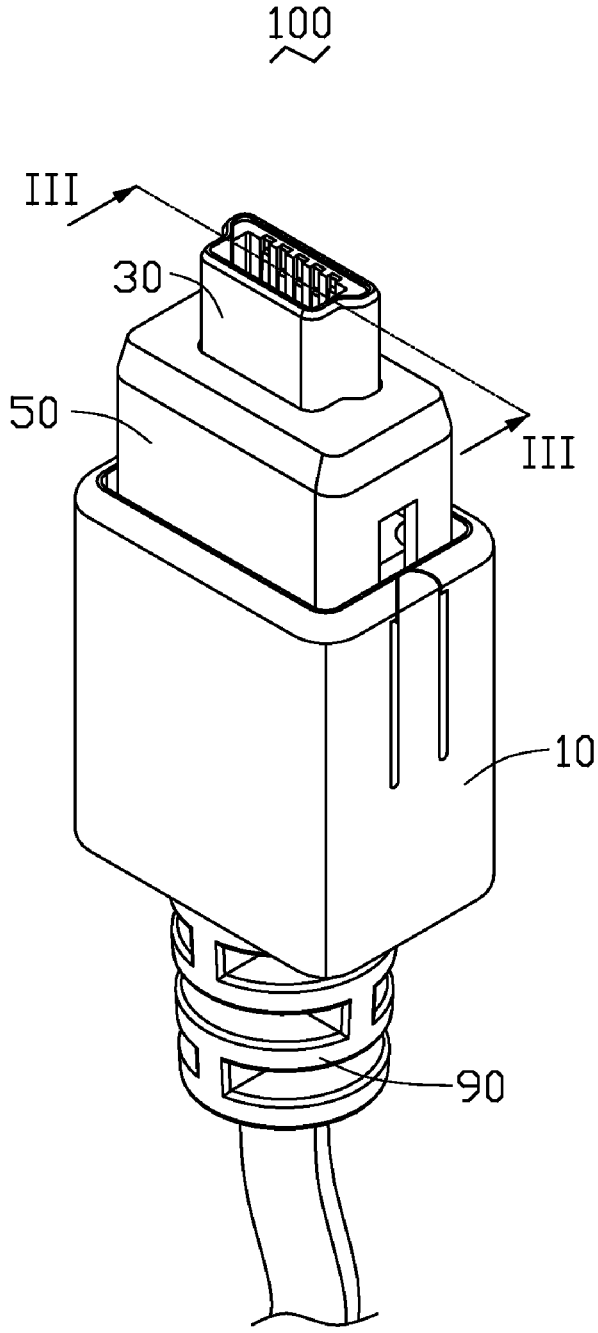
FIG. 1 is an assembled, isometric view of one embodiment of an adjustable plug, the adjustable plug including a main body, a connecting end, an adjustable end sleeve, two resilient members, and a cable.
Figure 2:
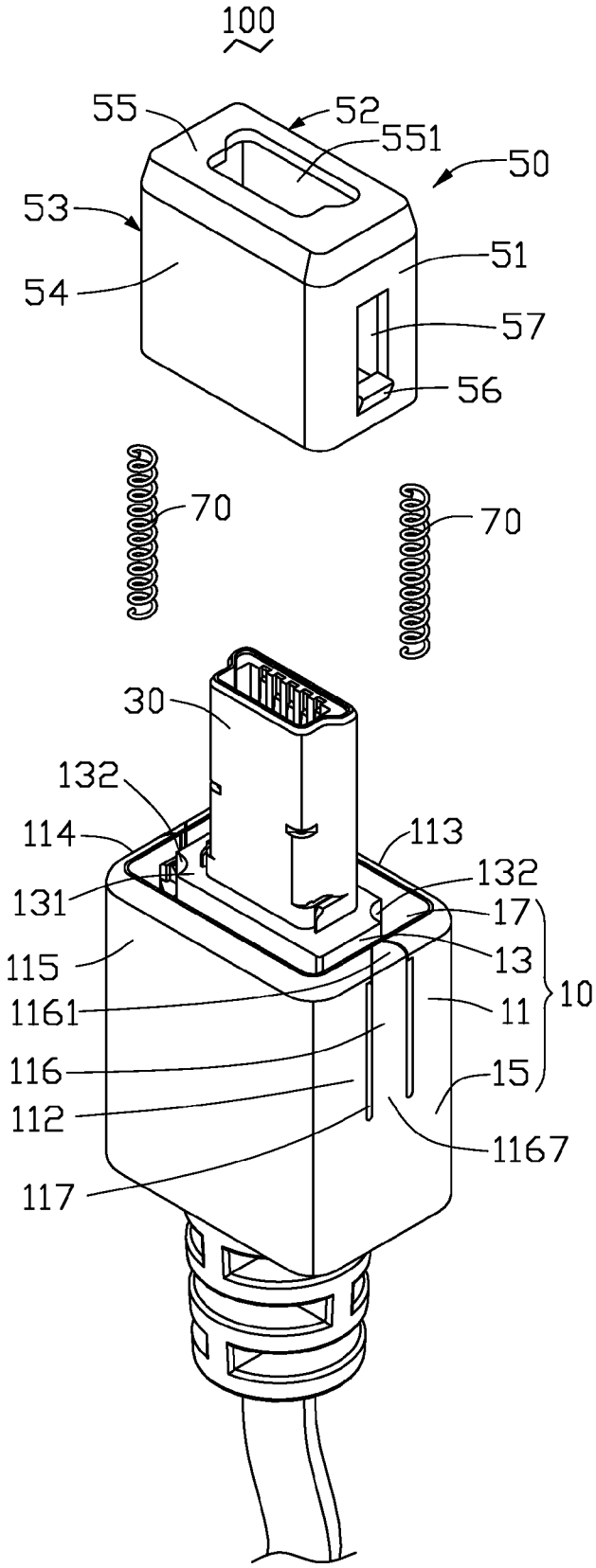
FIG. 2 is an exploded, isometric view of the adjustable plug of FIG. 1.

Referring to FIG. 1 and FIG. 2, an adjustable plug 100 of the present disclosure includes a main body 10, a connecting end 30, an adjustable end sleeve 50, at least one resilient member 70, and a cable 90. In the illustrated embodiment, there are two resilient members 70.

Figure 3:
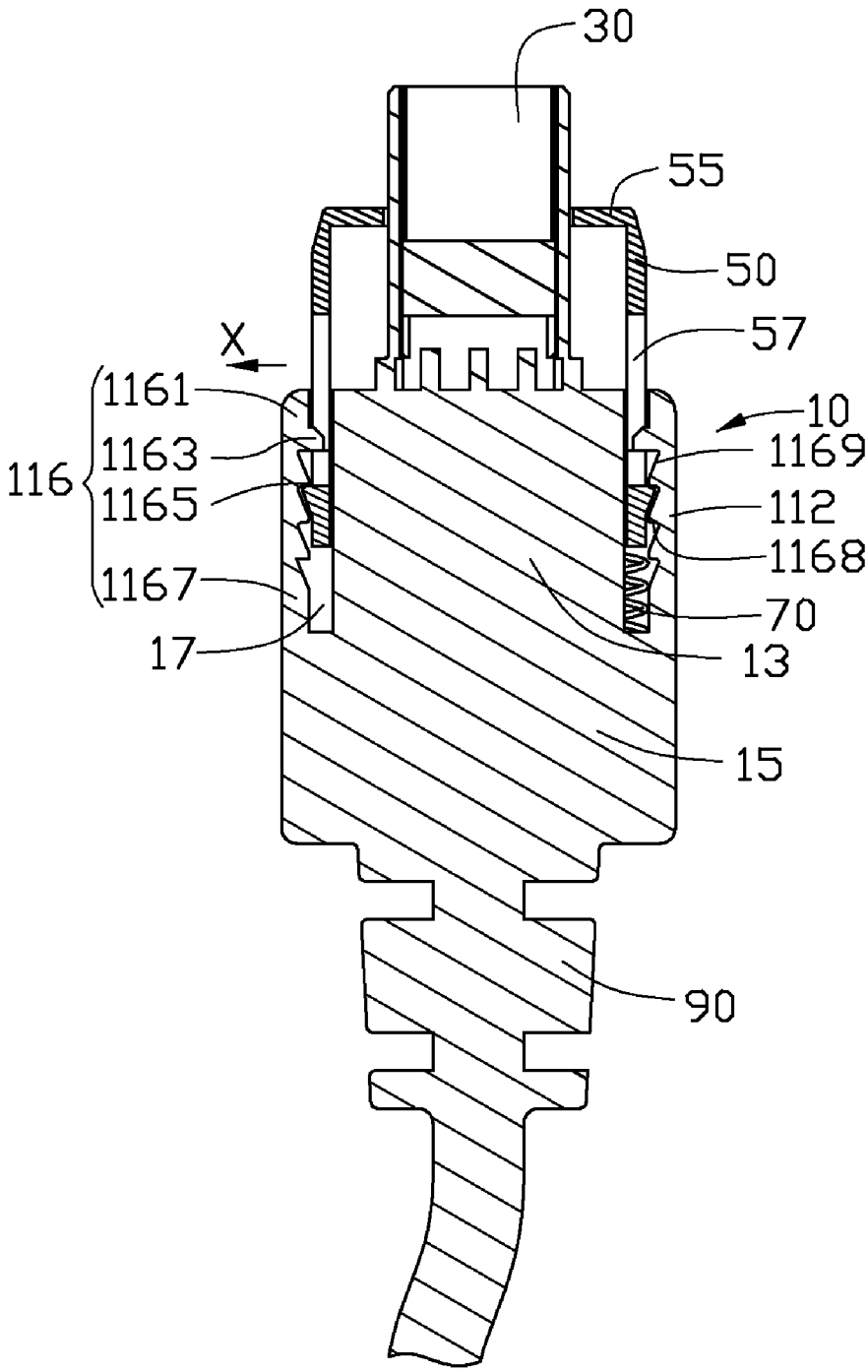
FIG. 3 is a cross-sectional view of the adjustable plug of FIG. 1, taken along line III-III.

The main body 10 includes a frame 11, a protrusion 13 surrounded by the frame 11, and a base 15. A receiving slot 17 is defined between the frame 11 and the protrusion 13. Referring also to FIG. 3, the frame 11 and the protrusion 13 are formed from a first end of the base 15. In one embodiment, the frame 11 includes a first sidewall 112, a second sidewall 113, a third sidewall 114, and a fourth sidewall 115 substantially perpendicularly extending from the first end of the base 15. The first and third sidewalls 112, 114 are opposite to each other and perpendicularly connected to the second and fourth sidewalls 113, 115. The first, second, third, and fourth sidewalls 112, 113, 114, and 115 cooperatively surround the protrusion 13.

The first sidewall 112 and the third sidewall 114 each forms a latching structure 116. The latching structure 116 defines two latching slots 117 in the first sidewall 112 or the third sidewall 114. The latching structure 116 includes a wedged portion 1161, a limiting portion 1163 connected to the wedged portion 1161, an array of teeth 1165, and a connecting portion 1167 connected to the base 15. The array of teeth 1165 are aligned between the limiting portion 1163 and the connecting portion 1167, and aligned along a line parallel to an extending direction of the latching slots 117. The limiting portions 1163 and the teeth 1165 are formed at inner walls of the first sidewall 112 and the third sidewall 114. The tooth 1165 includes a first surface 1168 and a second surface 1169 adjoining to the first surface 1168. In the illustrated embodiment, the first surface 1168 is a flat surface substantially perpendicular to a sliding direction of the adjustable end sleeve 50 and the second surface 1169 is a slant surface slant to the sliding direction. The second surface 1169 is closer to the connecting end 30 than the first surface 1168. Alternatively, the first surface 1168 may also be a slant surface to make a vertex angle of the tooth 1165 smaller. When the second sidewall 113 and the fourth sidewall 115 are squeezed towards each other, the first sidewall 112 and the fourth sidewall 115 expand outwards along with the latching structure 116. As a result, the latching structures 116 move away from the protrusion 13. The protrusion 13 has a first surface 131 in substantially the same plane as a distal end of the frame 11. The protrusion 13 defines two elongated depressions 132 in two diagonal corners. In one embodiment, the frame 11 is elastic.

The connecting end 30 is made of metal and positioned on the first surface 131 of the protrusion 13.

Figure 4:
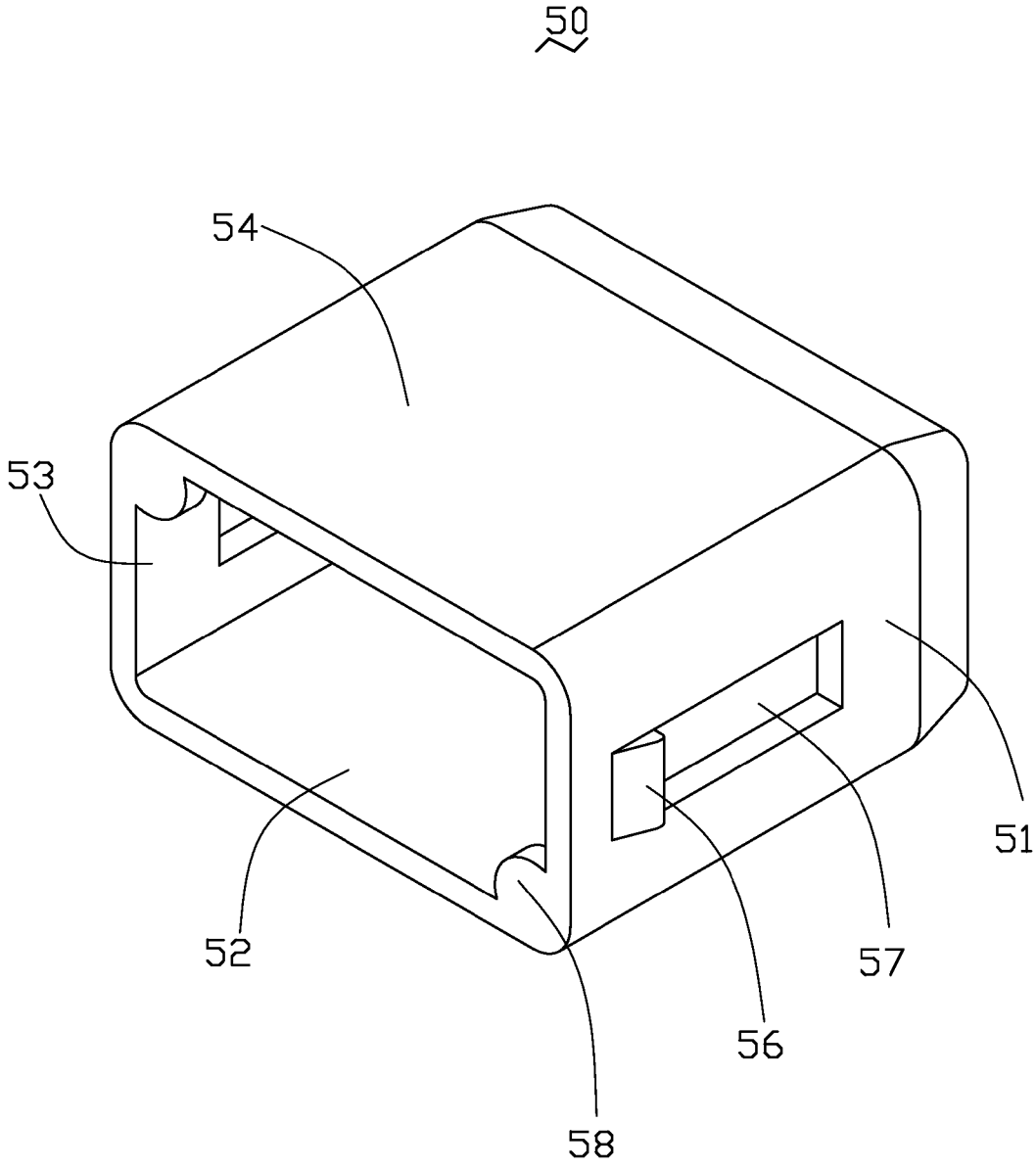
FIG. 4 is an isometric view of an adjustable end sleeve of the adjustable plug of FIG. 1.

Referring also to FIG. 4, in the illustrated embodiment, the adjustable end sleeve 50 is substantially a hollow cuboid having a first side sheet 51, a second side sheet 52, a third side sheet 53, a fourth side sheet 54, and an end sheet 55. The end sheet 55 defines an opening 551 having a shape substantially the same as a cross-section of the connecting end 30. The first and third side sheets 51, 53 each defines a guiding slot 57 and forms a latching projection 56 at an end of the guiding slot 57 away from the end sheet 55. The latching projection 56 is to resist the first surface 1168 of one of the tooth 1165. The adjustable end sleeve 50 forms two ribs 58 in two diagonal corners inside the adjustable end sleeve 50 corresponding to the depressions 132.

The resilient member 70 is configured to provide an elastic force to reset the adjustable end sleeve 50 to an original position. In the illustrated embodiment, the resilient member 70 is a column, helical, compression spring. However, the resilient member 70 may be a conical spring, a leaf spring, rubber, or any resilient structure capable of providing an elastic force. The cable 90 is connected to a second end opposite to the first end of the base 15.

The resilient members 70 are positioned in the elongated depressions 132 of the protrusion 13. The adjustable end sleeve 50 is engaged with the main body 10, with the first, second, third, and fourth side sheets 51, 52, 53, 54 of the adjustable end sleeve 50 partially inserted into the receiving slot 17 of the main body 10 and the ribs 58 of the adjustable end sleeve 50 aligned with the depressions 132 of the main body 10. The connecting end 30 extends through the opening 551 of the adjustable end sleeve 50 and part of the connecting end 30 is exposed out of the adjustable end sleeve 50. The latching projections 56 are engaged with two of the plurality of teeth 1165 of the frame 11. The limiting portions 1163 of the main body 10 are engaged in the guiding slots 57 of the adjustable end sleeve 50. Two ends of each resilient member 70 resist a bottom wall of the receiving slot 17 and the rib 58, and the resilient members 70 are compressed. The adjustable end sleeve 50 is latched to the main body 10 in an original position. The adjustable end sleeve 50 is slidable relative to the main body 10 along a direction parallel to the depressions 132. The limiting portions 1163 of the main body 10 prevent the adjustable end sleeve 50 from falling off the main body 10.

In use, the connecting end 30 is engaged in a socket receptacle (not shown), so as to electrically connect two members. When an initial length of the connecting end 30 exposed out of the adjustable end sleeve 50 is not long enough to fittingly engage with the socket, an external force is applied on the adjustable plug 100 to engage in the socket. The socket generates a counterforce applied on the end sheet 55 of the adjustable end sleeve 50. The adjustable end sleeve 50 slides into the main body 10 and further compresses the resilient members 70. After the adjustable end sleeve 50 slides through a certain distance, the latching projections 56 of the adjustable end sleeve 50 is released from a current position of the array of teeth 1165 and shifts to another position along the array of teeth 1165 of the main body 10. As such, a final length of the connecting end 30 protrudes out of the adjustable end sleeve 50 and engages with the socket. Thus, the adjustable plug 100 and the socket can be electrically connected sufficiently without exposing unnecessary portions of the connecting end 30.

If the exposed portion of the connecting end 30 is too long and cannot be completely engaged in the socket, the second sidewall 113 and the fourth sidewall 115 are pressed towards each other. The latching structures 116 of the first sidewall 113 and the third sidewall 114 are squeezed to rotate, so that the latching projections 56 of the adjustable end sleeve 50 disengage from the teeth 1165 (two first teeth 1165) of the main body 10. At this moment, an elastic force of the resilient members 70 forces the adjustable end sleeve 50 to slide out from the main body 10. When the end sheet 55 of the adjustable end sleeve 50 contacts the socket, the external force is removed. The latching structures 116 of the first sidewall 113 and the third sidewall 114 rotate to reset to the original state and return to an original position, such that the latching projections 56 of the adjustable end sleeve 50 reengage with two teeth 1165 (two second teeth 1165) of the main body 10. The portion of the connecting end 30 protruding out of the adjustable end sleeve 50 engages in the socket completely.

The connecting end 30 will always completely engage with sockets of various depths, because the adjustable end sleeve 50 is slidable relative to the main body 10 to adjust the exposed portion of the connecting end 30 protruding out of the adjustable end sleeve 50.

It may be appreciated that the frame 11 and the adjustable end sleeve 50 may be other shapes such as cylindrical-shaped. In addition, the teeth 1165 may be formed on the protrusion 13 of the main body 10.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. An adjustable plug, comprising:

a main body forming a plurality of teeth, at least two teeth are aligned along a direction parallel to a sliding direction of the adjustable end sleeve;

an adjustable end sleeve slidably positioned on the main body, the adjustable end sleeve forming at least one latching projection; and a connecting end protruding from the main body, extending through the adjustable end sleeve, and protruding out of the adjustable end sleeve;

wherein the at least one latching projection is engagable with different teeth, to latch the adjustable end sleeve in different positions relative to the main body.

2. The adjustable plug of claim 1, wherein a part of the main body is deformable; the at least one latching projection of the adjustable end sleeve engages with or disengages from the teeth of the main body to change position of the adjustable end sleeve; when change position of the adjustable end sleeve, the adjustable end sleeved is pushed to slide inwards to latch with a deeper tooth, and the deformable part of the main body is deform to unlatch the at least one latching projection from the tooth, thus allow the adjustable end sleeve to slide outwards to latch a shallower tooth.

3. The adjustable plug of claim 2, wherein the adjustable plug further comprises at least one resilient member resisting the main body and the adjustable end sleeve.

4. The adjustable plug of claim 3, wherein the at least one resilient member is at least one helical, compression spring.

5. The adjustable plug of claim 3, wherein the main body comprises a frame, a protrusion, and a base; the frame and the protrusion are connected to a first end of the base, the protrusion is surrounded by the frame, and a receiving slot is defined between the frame and the protrusion; sidewalls of the adjustable end sleeve are received in the receiving slot of the main body.

6. The adjustable plug of claim 5, wherein the adjustable plug further comprises a cable connected to a second end of the base of the main body opposite to the first end.

7. The adjustable plug of claim 5, wherein the frame forms at least one latching structure, two latching slots are defined in the frame to form the at least one latching structure; the at least one latching structure comprises a wedged portion, a limiting portion connected to the wedged portion, the teeth, and a connecting portion connected to the base; the teeth are positioned between the limiting portion and the connecting portion; the at least one latching structure is deformable.

8. The adjustable plug of claim 7, wherein the frame comprises a first sidewall, a second sidewall, a third sidewall, and a fourth sidewall substantially perpendicularly extending from the first end of the base; the first and third sidewalls are opposite to each other and perpendicularly connected to the second and forth sidewalls; the first, second sidewall, third, and fourth sidewalls cooperatively surround the protrusion; each of the first sidewall and the third sidewall forms the latching structure.

9. The adjustable plug of claim 8, wherein the protrusion comprises a first surface substantially coplanar with a distal end of the frame, the protrusion defines two elongated depressions in two corners; the adjustable end sleeve forms two ribs in two corners; the at least one resilient member comprises two resilient members positioned in the elongated depressions of the protrusion between the base and the ribs of the adjustable end sleeve.

10. The adjustable plug of claim 1, wherein the adjustable end sleeve is a hollow cuboid having a first side sheet, a second side sheet, a third side sheet, a fourth side sheet, and an end sheet, the end sheet defines an opening for allowing the connecting end to pass therethrough, each of the first and third side sheets defines a guiding slot and forms the latching projection at an end of the guiding slot away from the end sheet.

11. An adjustable plug, comprising:

a main body forming a plurality of teeth, at least two teeth are aligned along a direction parallel to a sliding direction of the adjustable end sleeve;

a connecting end fixed on the main body; and an adjustable end sleeve, the adjustable end sleeve forming at least one latching projection, wherein an end of the connecting end extends through the adjustable end sleeve; the at least one latching projection of the adjustable end sleeve is configured to latch to different teeth of the main body to adjust exposure of the connecting end protruding out of the adjustable end sleeve.

12. The adjustable plug of claim 11, wherein a part of the main body is deformable; the at least one latching projection of the adjustable end sleeve engages with or disengages from the teeth of the main body to change position of the adjustable end sleeve; when change position of the adjustable end sleeve, the adjustable end sleeved is pushed to slide to latch with a deeper tooth, and the deformable part of the main body is deform to unlatch the at least one latching projection from the tooth, thus allow the adjustable end sleeve to slide to latch a shallower tooth.

13. The adjustable plug of claim 11, wherein the adjustable plug further comprises at leak one resilient member resisting the main body and the adjustable end sleeve.

14. The adjustable plug of claim 13, wherein the at least one resilient member is at least one helical, compression spring.

15. The adjustable plug of claim 11, wherein the adjustable plug further comprises a cable connected to an end of the base of the main body opposite to the adjustable end sleeve.

16. The adjustable plug of claim 2, wherein each of the teeth includes a first surface and a second surface adjoining to the first surface, the second surface is closer to the connecting end than the first surface; the latching projection resists the first surface of one of the tooth.

17. The adjustable plug of claim 12, wherein each of the teeth includes a first surface and a second surface adjoining to the first surface, the second surface is closer to the connecting end than the first surface; the latching projection resists the first surface of one of the tooth.

* * * * *